United States Patent [19]

Ehmig et al.

[11] Patent Number: 5,036,746

[45] Date of Patent: Aug. 6, 1991

[54] BELT-SHAPED LOADING STRIP

[75] Inventors: Gerhard Ehmig, Rankweil, Austria; Rolf Bereiter, Grabs, Switzerland; Edmund Narobe, Feldkirch, Austria

[73] Assignee: Hilti Aktiengesellschaft, Schaan, Liechtenstein

[21] Appl. No.: 502,637

[22] Filed: Mar. 30, 1990

[30] Foreign Application Priority Data

Mar. 31, 1989 [DE] Fed. Rep. of Germany ..... 3910392

[51] Int. Cl.[5] ..... F42B 3/00

[52] U.S. Cl. ..... 86/10; 89/35.01; 102/470

[58] Field of Search ..... 86/10; 89/35.01; 102/281, 530, 531, 470; 42/57

[56] References Cited

U.S. PATENT DOCUMENTS 2,667,837 2/1954 Musser et al. ..... 102/39

4,920,885 5/1990 Bowman et al. ..... 102/281

*Primary Examiner*—Brian S. Steinberger

*Attorney, Agent, or Firm*—Toren, McGeady & Associates

[57] ABSTRACT

A loading strip (1) for supplying individual explosive powder charges in a setting tool is formed of an elongated belt-shaped member (2). The member has openings (2*a*) therethrough with a hollow receptacle (3) projecting outwardly at each opening from one surface of the member (2). The interior of the hollow receptacle (3) in combination with the corresponding opening (2*a*) form a space for holding an explosive powder charge. Annular gap (2*b*) encircles each opening (2*a*) and extends inwardly from the opposite side of the member from the receptacles. A bulge-like projection extends into the space formed by the receptacle and the member. The projection has a hollow recess (2*c*) located eccentrically relative to the opening and the hollow space and faces the opposite side of the member (2). An ignition medium (6) is placed in the hollow recess (2*c*). A base plate (7) forms a closure for the explosive powder charge space and the ignition medium hollow recess.

10 Claims, 1 Drawing Sheet

Fig. 1
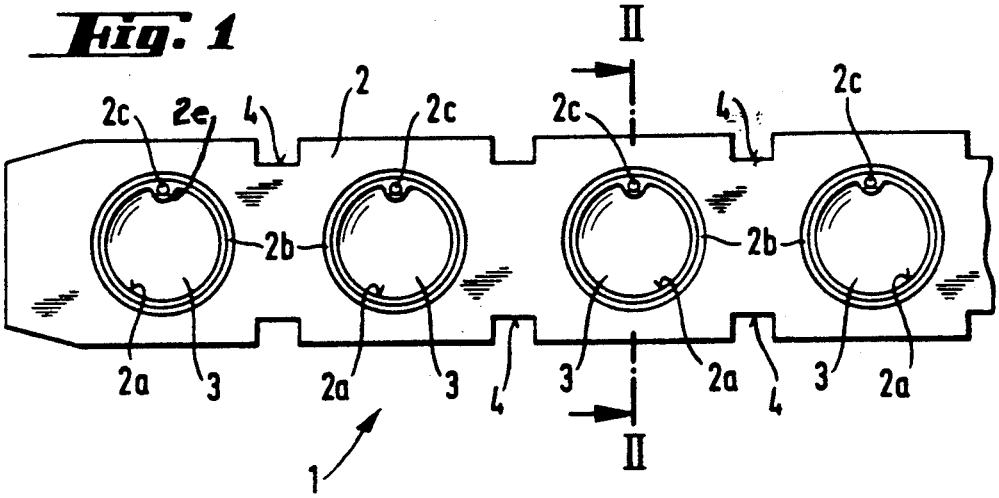
Fig. 2
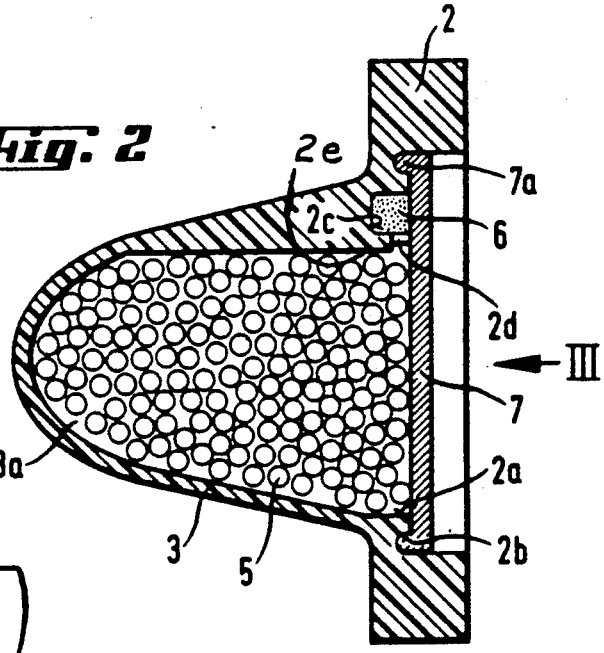
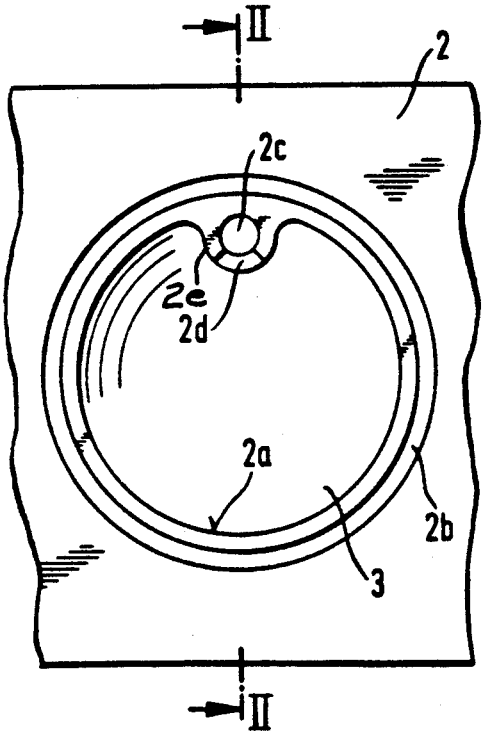
Fig. 3

BELT-SHAPED LOADING STRIP

BACKGROUND OF THE INVENTION

The present invention is directed to a belt-shaped loading strip for supplying individual explosive powder charges in a setting tool. Receptacles for the explosive powder charge project from one surface of the strip forming a hollow space for the charge. The outside surface of the receptacle is truncated-cone-shaped. An opening aligned with the receptacle extends through the belt-shaped strip. An annular gap encircles the opening and is open toward the surface of the belt opposite the surface from which the receptacles extend. A base plate fits into the annular gap and closes the opening through the belt and the hollow space within the receptacle. The openings are equally spaced in an elongated direction of the strip.

A loading strip of the type mentioned above is disclosed in EU-A 0 273 777.

A considerable disadvantage of this known loading strip is that the volume formed by the receptacle and the opening hold only an inadequate quantity of the explosive powder charge and, as a result, affords a driving force which is too small for the majority of the uses of the setting tool. Furthermore, the known ignition medium or detonator composition involves high costs in view of the large quantity required.

SUMMARY OF THE INVENTION

Therefore, the primary object of the present invention is to provide a loading strip capable of holding a large quantity of the explosive powder charge for affording a correspondingly high driving force which is suitable for use with an economical ignition medium or detonator composition.

In accordance with the present invention, a hollow recess is provided in the loading strip between the annular gap and the hollow space within the receptacle and the opening for receiving an ignition medium. The hollow space is open toward the opposite surface of the belt-shaped strip from the receptacles and is closed by a base plate.

Due to the eccentric arrangement of the hollow recess for the ignition medium relative to a central axis of the hollow space within the receptacle and the opening, a considerably grater volume is available for the explosive powder charge as compared to the ignition medium, since the hollow recess is formed within an inwardly directed projection of the receptacle and strip where the projection has a bulge-like configuration and is located only in the region of the hollow recess for the ignition medium. The eccentrically arranged ignition medium is distinguished by the small quantity required, thereby resulting in low costs and providing a reduction in contamination of the setting tool. The placement of the ignition medium can be achieved by filling the required quantity of the medium as a moist mass into the hollow recess. After the ignition medium and the explosive powder charge are filled into the respective spaces, they are covered by a base plate.

Advantageously, the direction and amount of the eccentricity of the hollow recess is the same for all of the hollow spaces within the receptacles, so that the hollow recess can be eccentrically offset in the elongated direction or transversely to the elongated direction. Accordingly, a dependable activation of the ignition medium by an ignition device is assured due to the stationary position of the ignition medium in the setting tool. Moreover, the loading strip affords a consecutive arrangement of the spaces formed by the receptacles which has an advantageous effect when introducing the ignition medium, since the loading strip is moved in a single feed direction for alignment with the ignition device.

Preferably, the volume of the hollow recess for the ignition medium corresponds to 0.002 to 0.01 times the sum of the volumes of the receptacle and the opening through the strip. A hollow recess of such size permits an adequate amount of ignition medium for assuring a reliable ignition of the entire explosive powder charge, though only a small quantity of the ignition medium is used.

In a preferred embodiment, the loading strip is formed monolithically of plastics material and includes a belt-shaped member and the receptacles. The advantages of such an arrangement is particularly notable in the low costs of the material and fabrication. The base plate is preferably formed of metal, such as brass or steel.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings:

FIG. 1 is a plan view of a portion of a loading strip embodying the present invention;

FIG. 2 is an enlarged sectional view through the loading strip taken along the lines II—II in FIG. 1, including the explosive powder charge, the ignition medium, and the base plate; and FIG. 3 is an enlarged partial view of the loading strip displayed in FIG. 1.

DETAILED DESCRIPTION OF THE INVENTION

An elongated loading strip 1 for individual explosive powder charges is shown in FIG. 1 and is formed by a belt-shaped member 2 having a pair of opposite elongated surfaces and a pair of narrow edges extending in the elongated direction between the surfaces. A plurality of bowl-like receptacles 3 project outwardly from one surface of the member 2, transversely of the elongated direction. The receptacles are spaced apart in a uniform manner in the elongated direction of the loading strip 1. At spaced locations between the receptacles 3, elongated edges of the member 2 are provided with cut-outs 4 for engagement with a conveying device in a setting tool for moving the individual receptacles into position for supplying driving force to a member to be driven from the setting tool.

As shown in FIG. 2, each of the receptacles 3 form a hollow space 3*a* in communication with an opening 2*a* in the member 2. Within the belt-shaped member 2, an annular gap 2*b* encircles the opening 2*a* and faces the surface of the member on the opposite side from the receptacle 3. The annular gap 2*b* extends radially outwardly from the opening 2*a*. Each receptacle 3 and the belt-shaped member 2 form an inwardly directed projection 2e extending into the space within the receptacle, note FIG. 3. In the region of the projection 2e in the belt-shaped member 2, a hollow recess 2c is formed with the recess being open toward the annular gap 2b. As can be seen in FIG. 3, the hollow space 3a has a circular cross section with the projection 2e extending into such cross-section. Further, a penetration 2d extends between the hollow recess 2c and the hollow space 3a.

An explosive powder charge 5 is filled into the hollow space 3a and the opening 2a, note FIG. 2. An ignition medium 6 in the form of a moist mass is introduced in a simple manner into the hollow recess 2c. When the ignition medium is ignited it provides ignition of the entire explosive powder charge through the penetration 2d. The opening 2a and the hollow recess 2c are closed in the direction facing away from the receptacle 3 by a base plate 7 having a circumferential collar 7a which snaps into the annular gap 2b for retention purposes.

While specific embodiments of the invention have been shown and described in detail to illustrate the application of the inventive principles, it will be understood that the invention may be embodied otherwise without departing from such principles.

We claim:

1. A loading strip (1) for supplying individual explosive powder charges in a setting tool, comprising an elongated belt-shaped member (2) having an elongated first surface and an oppositely facing elongated second surface, a pair of elongated narrow edges extending between said first and second surfaces, openings (2a) spaced apart in the elongated direction and extending through said member between said first and second surfaces, at each said opening (2a) a hollow receptacle (3) is connected to and projects outwardly from the first surface of said member with said receptacle forming a hollow space (3a) therein aligned with a corresponding said opening (2a), an annular gap (2b) in said member extending inwardly from said second surface toward and spaced from said first surface and encircling said opening (2a), a base plate (7) forming a closure for said hollow space (3a) and said opening (2a) for retaining an explosive powder charge therein, said base plate (7) having an annular collar (7a) insertable into said annular gap (2b), each said opening (2a) and corresponding hollow space (3a) have a central axis extending transversely of the elongated direction of said member, each of said receptacles in combination with said member forms a bulge-like projection 2e located eccentrically relative to said central axis and extending inwardly from said receptacle transversely of the central axis into said hollow space (3a) and said opening (2a) toward and spaced from said central axis on one side only of said central axis, and said projection having a hollow recess (2c) therein open toward said second surface for receiving an ignition medium (6), and said base plate (7) forms a closure for said hollow recess (2c).

2. A loading strip (1), as set forth in claim 1, wherein the position and amount of the eccentricity of said hollow recess (2c) is the same in all said projections arranged consecutively in the elongated direction of said belt-shape member (2a).

3. A loading strip (1), as set forth in claim 2, wherein each said hollow recess (2c) has a volume in the range of 0.002 to 0.01 times the sum of the volume of the corresponding said opening (2a) and hollow space (3a) of said receptacle.

4. A loading strip (1) as set forth in claim 1, wherein said belt-shaped member (2) and said receptacle (3) are a one-piece member formed of a plastics material.

5. A loading strip (1), as set forth in claim 1, wherein said receptacles (3) have a truncated, conically shaped outside surface.

6. A loading strip (1), as set forth in claim 1, wherein each said opening (2a) and corresponding hollow space (3a) are symmetrical relative to the central axis thereof.

7. A loading strip (1), as set forth in claim 1, wherein said belt-shaped member has recesses formed inwardly in said narrow edges thereof spaced apart in the elongated direction for cooperation with means in the setting tool for moving said loading strip therethrough.

8. A loading strip (1), as set forth in claim 4, wherein said base plate (7) is formed of metal.

9. A loading strip (1), as set forth in claim 1, wherein said projection has a penetration (2d) therethrough connecting said hollow recess (2c) and said hollow space (3a).

10. A loading strip (1), as set forth in claim 9, wherein said hollow recess (2c) contains an ignition medium (6), said hollow space (3a) contains an explosive powder charge (5) so that when said ignition medium is ignited it provides ignition of the explosive powder charge through said penetration (2d).

* * * * *